United States Patent [19]

Lowry

[11] Patent Number: 4,974,328

[45] Date of Patent: Dec. 4, 1990

[54] PENDULUM BOW SIGHT

[76] Inventor: Abner P. Lowry, 6746 Drayton St., Jacksonville, Fla. 32208

[21] Appl. No.: 381,275

[22] Filed: Jul. 18, 1989

[51] Int. Cl.[5] ..... F41G 1/46

[52] U.S. Cl. ..... 33/265; 124/87

[58] Field of Search ..... 33/265, 292, 260, 283, 33/291; 124/87

[56] References Cited

U.S. PATENT DOCUMENTS

| | | | |
|---|---|---|---|
| 2,569,796 | 10/1951 | Browning | 33/283 |
| 2,925,656 | 2/1960 | Genovese | 33/265 |
| 3,013,336 | 12/1961 | Pennington | 33/265 |
| 4,120,096 | 10/1978 | Keller | 33/292 |
| 4,532,717 | 8/1985 | Watson et al. | 33/265 |
| 4,580,349 | 4/1986 | Hebb et al. | 33/265 |
| 4,616,422 | 10/1986 | Gaddy | 33/265 |
| 4,711,036 | 12/1987 | Morris | 33/265 |
| 4,720,919 | 1/1988 | Saunders | 33/265 |

*Primary Examiner*—William A. Cuchlinski, Jr
*Assistant Examiner*—Alvin Wirthlin
*Attorney, Agent, or Firm*—Arthur G. Yeager

[57] ABSTRACT

A pendulum bow sight adapted for use on bows used from elevated positions such as tree stands and the like includes a mounting frame for attaching a pendulum and a pendulum frame to a bow. The pendulum and pendulum frame are pivotally mounted to the mounting frame to move independently of each other. The lower surface of the pendulum frame, which is formed in an arc, has square teeth which engage similar teeth on an upwardly disposed surface at the lower end of the pendulum. The pendulum frame has integral elongate slots to accept a slidably mounted sighting pin. A fixed sighting pin is mounted through the pendulum/pendulum frame pivot axis. Range and tree stand height markings can be placed on the pendulum frame. The sight can be mounted for use by either a right-handed or left-handed archer.

30 Claims, 5 Drawing Sheets

PENDULUM BOW SIGHT

BACKGROUND OF THE INVENTION

1. Field of the Invention

The present invention relates to bow sights, and in particular to bow sights for use both on level ground and elevated stand applications. The present invention includes both sighting and range-finding capability.

2. Prior Art

Archery, especially in hunting, involves shooting from a level ground position to a target on either level or sloping terrain. In addition, shooting from tree stands of various heights is also common. Bow sights are calibrated by setting up a target of a given height and at a measured distance, usually twenty yards, through which the arrow will have a flat trajectory. The bow sight is calibrated by aligning a sight on the bow string with a movable shooting pin positioned on a frame attached t the bow. The shooting pin is fixed into position at a point where a fired arrow strikes the target. The shooting pin is now fixed at a twenty yard range and the bow is calibrated for that range. Fixed pins for greater distances are often used and are positioned vertically below the flat trajectory pin. As the bow is tilted upwardly to bring one of these lower fixed pins in alignment with the target and the bow string sight, the bow sight can be calibrated by trial-and-error for these greater distances.

Pendulum sights have been developed for use with sighting pins to provide for bow sight calibration at distances greater than the flat-trajectory range. In U.S. Pat. No. 4,580,349 (Webb et al.) a pendulum is attached to a bow frame and provides a means by which a range mark can be recorded to mark the position of the pendulum at the longer calibrated distances. When the pendulum is aligned with a previously established range mark, the bow will be tilted at the correct angle for use with a given sighting pin. A plurality of sighting pins are used, each for a particular range.

When hunting from an elevated tree stand, the bow is initially calibrated for a flat trajectory range, such as twenty yards, as measured from a point below the tree stand and the target. Pendulum sighting devices are also used in the application. These devices work on the principle that relative movement of a pin mounted on the pendulum is different than that of the fixed pin with respect to the bow string sight when the bow is raised or lowered in angle from a tree stand position. The pendulum is moved up or down the bow frame until the arrow strikes the target when the pendulum pin is on the target. Once locked into position, the pendulum is calibrated for only that specific tree stand height. If the archer were to move to a tree stand having higher elevation and aim at the same target used in calibration, the greater downward angle of the bow will cause greater relative movement of the pendulum and indicate that the target is further away than it actually is. The inaccurate distance reading results from the increased elevation with respect to the elevation at which the bow sight was calibrated. This increase in elevation causes the pendulum pin to move upwardly with respect to the line-of-sight through the bow string sight initially established. Devices in the prior art would have to be recalibrated by lowering the pendulum mounting frame to place the pendulum pin in alignment with the target. See U.S. Pat. Nos. 4,120,096; 4,368,581; and 4,616,422. These devices acknowledge the limitations of the respective disclosed sighting apparatus and simply assume that, since most hunting distances are at ranges of less than thirty yards, any inaccuracies that arise due to elevation changes are not important. In short, prior art pendulum devices assume a given tree stand height range of ten to thirty feet or so and a usable range of less than thirty yards. The resulting inaccuracies are ignored.

The principles involved in changed elevation are also applicable to pendulum devices used in situations where the terrain itself may be sloping upwardly or downwardly. The pendulum pin should be at the same point above a line-of-sight from a fixed shooting pin through the bow string sight for the same range greater than the flat trajectory range regardless of elevation. To put it another way, the line-of-sight through the pendulum pin should be in the same angular position with respect to the arrow for the same range regardless of elevation. The arrow always remains at 90° with respect to the bow. The prior art devices lack the capability t alter the relative movement of the pendulum pin as elevation changes and accordingly, these devices are only accurate at the height at which they were calibrated.

What is desired in a bow sighting device is a pendulum sight wherein the relative angular movement of the movable pendulum pin can be modified depending upon the elevation at which it is used. Such a sighting device would also have range indicating capability when properly calibrated.

SUMMARY OF THE INVENTION

In one aspect of the present invention there is provided a bow sight assembly to enable an archer to aim at a target accurately when using a bow, and preferably including a bow string sight, from a plurality of elevated positions or from a ground level position. The sight assembly includes mounting means for attaching the bow sight to a bow, a first pendulum having an upper portion and a lower portion and being adapted to respond to gravity, the lower portion including a weight portion, a second pendulum, preferably shaped as a quadrant member, adapted to respond to gravity, and pivot means for mounting the first and second pendulums to the mounting means about a common pivot axis above the center of gravity of each of the pendulums. The pivot means is adapted to allow each of the pendulums to move freely about the axis. A first sighting element is provided with means for securing it to the second pendulum and a second sighting element spaced away from the first element and fixed with respect to the pendulums. Selective means secures the first pendulum to the second pendulum at each of a plurality of different locations to cause pivotal motion of the second pendulum in response to movement of the weight portion when the first pendulum is moved from one location to another location for raising or lowering the elevation of the first element with respect to the second element. Other aspects are seen wherein the first pendulum includes a pointer for indicating a selected location of the first pendulum with respect to the second pendulum which has an upper portion and a lower arcuate portion adapted to receive indicia thereon by the archer to record the position of the pointer at each selected location of the first pendulum. The first pendulum includes a vertically disposed rib along the length thereof for indicating a selected location of the first pendulum with respect to the second pendulum, and the arcuate portion is adapted to receive second indicia thereon by the archer to record the position of the rib at each selected location of the first pendulum. The pointer is used for indication of a plurality of corresponding elevated positions of an archer, and of a plurality of corresponding distances of a target from an archer. The second pendulum also includes two elongated slots and means to releasably fasten the first sighting element at any position along the length of either slot. Each slot is located in a spaced arm member that define, with the arcuate member, the quadrant member. The second sighting element is aligned with the pivot axis.

Additional aspects include placement of the first pendulum closely adjacent the rear surface of the second pendulum. The selective means includes first and second teeth oppositely disposed on respective first and second pendulums with the first teeth releasably and cooperatively engaged with the second teeth to secure the first pendulum to the second pendulum at any location. The upper portion of the first pendulum includes a first passageway therethrough for receiving the pivot means. The first passageway has a deformably resilient concave wall portion for selectively allowing movement of the first pendulum with respect to the second pendulum or the plastic materials from which the pendulums are made permit momentary deformation to cause disengagement of the first teeth from said second teeth when so deformed and resiliently to interlock when released. The first teeth are disposed upwardly on the upper portion of a boss with an arcuate lower portion of the second pendulum carrying the second teeth disposed downwardly.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
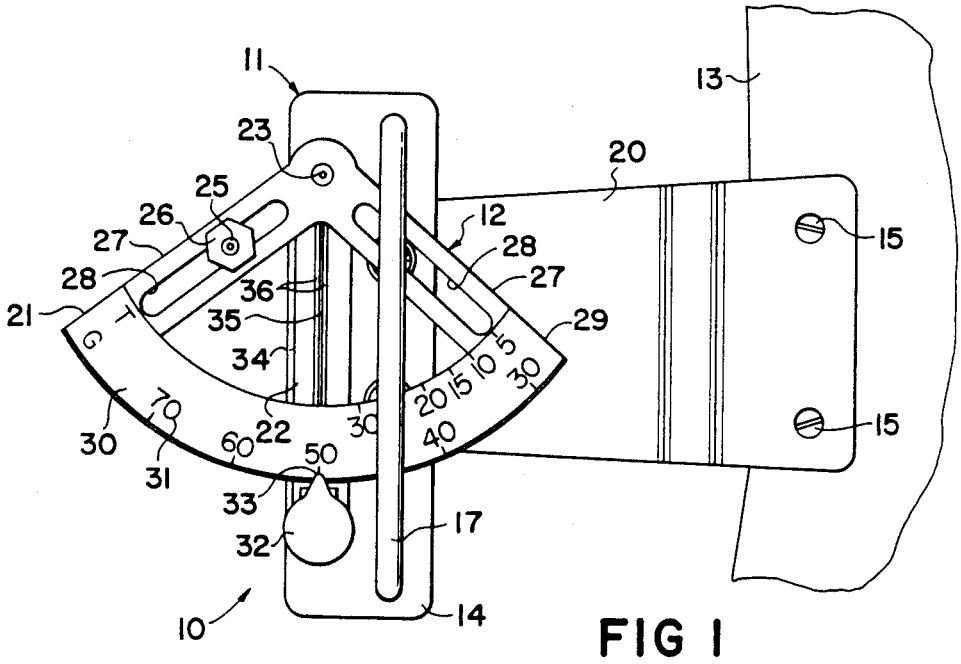
FIG. 1 is a front elevational view of the pendulum bow sight in accord with the present invention.
Figure 10:
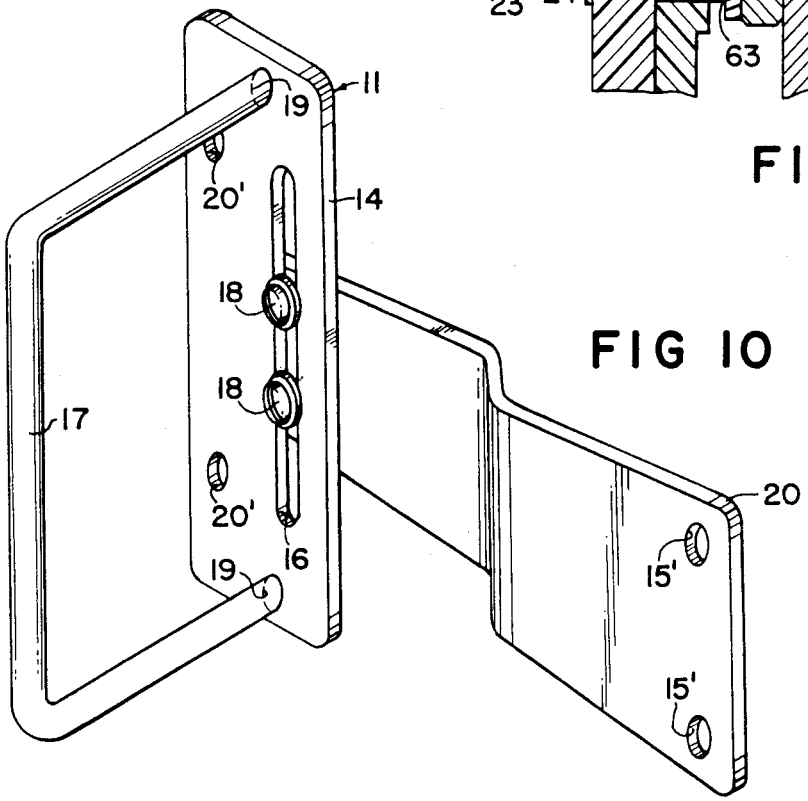
FIG. 10 is an isometric view of the mounting hardware used in FIG. 1.
Figure 11:
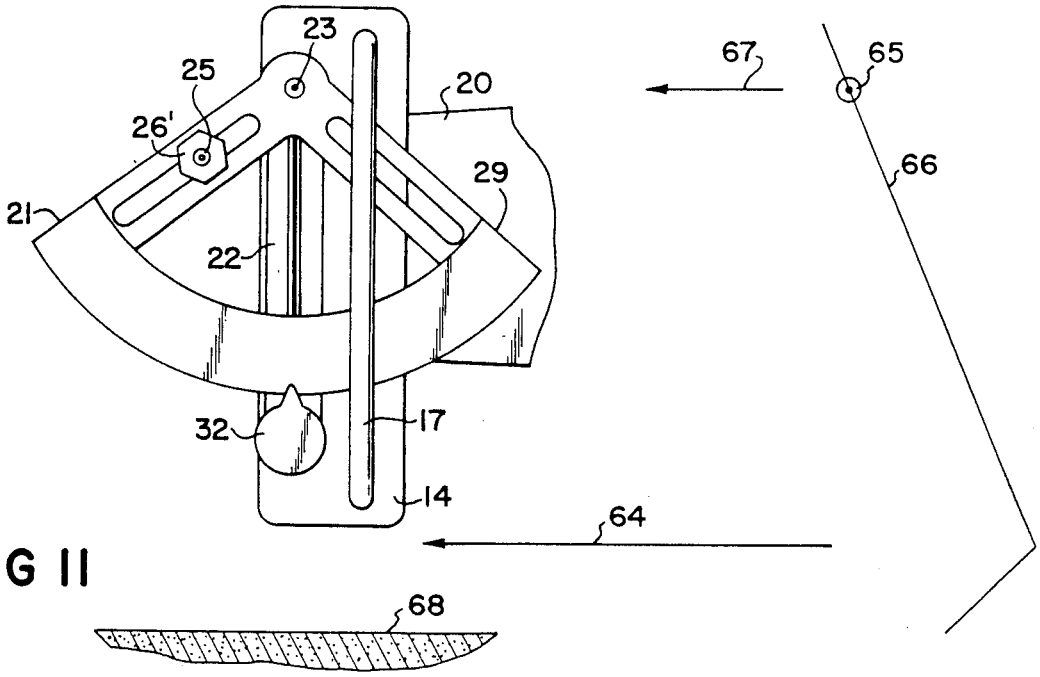
FIGS. 11–15 are pictorial diagrams illustrating the calibration and use of the pendulum bow sight of FIG. 1.

With reference now to the drawings, the pendulum bow sight in accordance with the present invention is depicted in FIG. 1 at the numeral 10. A mounting frame 11 is used to secure the pendulum bow sight 12 to a bow 13 via a mounting bracket 20 and screws 15 in screw holes 15' (see FIG. 10). As further seen in FIG. 10, elevation bracket 14 has vertical slot 16 and a frame guard 17 which is fitted into holes 19 and welded into place. Screws 18 are used to establish the vertical position of the pendulum sight 12 via slot 16. The mounting apparatus can be inverted and positioned on the other side of bow 13 for a left-handed archer.

Figure 2:
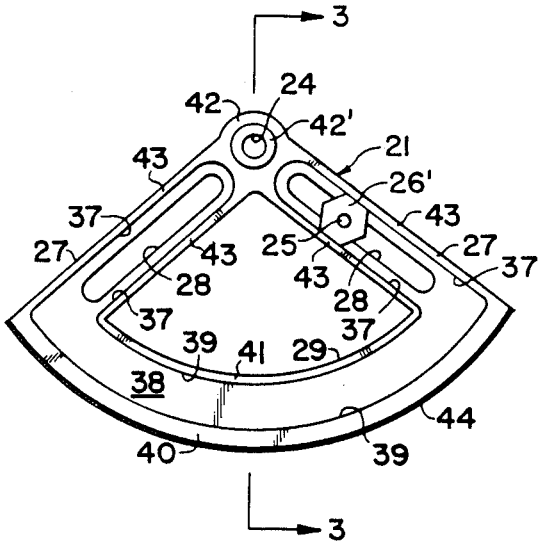
FIG. 2 is a rear elevational view of the pendulum frame of FIG. 1 and includes a movable sighting pin mounted thereon.

Referring to FIGS. 1 and 2, the pendulum bow sight 12 has a pendulum frame 21 and a pendulum 22 which is mounted to frame 21 to pivot around a pivot axis defined through fixed sighting pin 23 positioned through a hole 24 in frame 21. A sliding sighting pin 25 is mounted on the frame 21 via a front and rear hex nut 26, 26', respectively. The frame 21 includes two arms 27 with elongated slots 28 which allows pin 25 to be positioned for purpose of sighting-in the bow 13 as will be more fully described hereinbelow. The frame 21 has an arcuate portion 29 integral with the arms 27 and has a non-reflecting marking strip 30 attached thereon via glue or other appropriate means. Markings 31, indicating tree stand height in feet and ground range in yards, are placed on strip 30 as will be described. The pendulum 22 has a base 32 formed with pointer 33 used to read the position of the pendulum with respect to markings 31. The pendulum 22 also includes an arm 34 having a rib 36 which defines a vertical sight line 35 cut therein.

Figure 3:
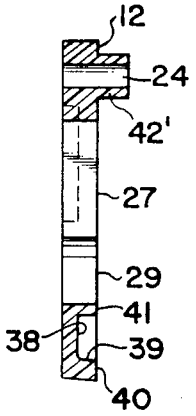
FIG. 3 is a cross section view of the frame of FIG. 2 taken on the line 3—3.
Figure 4:
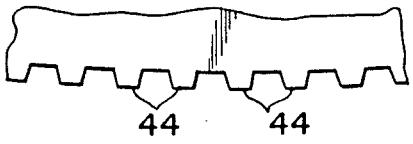
FIG. 4 is an enlarged partial illustration of the teeth on the lower surface of the frame in FIG. 2.

A rear view of the pendulum frame 21 is illustrated in FIG. 2. The frame 21 is molded in one piece from glass fiber-reinforced nylon. The rearward surface of arms 27 are formed with two parallel walls 37 defined by bosses 43 that integrally connect to parallel arcuate walls 39 defined by bosses 40, 41 on the rear of arcuate portion 29 and define a lower surface 38. This molded form lowers weight without any loss of strength or rigidity. The rear surface 38 of the arms 27 provides a channel for securing the rear hex nut 26' therein. The nut 26' has been cut to fit within the walls 37 where it is free to slide along channel 38 for positioning pin 25 but not free to rotate when forward nut 26 is loosened slightly. The upper portion 42 has laterally extending circular boss 42' with hole 24 formed therethrough (see also FIG. 3). On the lower edge of arcuate portion 29 of frame 21 there are integrally formed teeth 44 (see FIG. 4). Preferably, there are one hundred and ten teeth 44 extending through an arc of 110° and, for reasons of fabrication, they are formed at a slight angle as seen in FIG. 4.

Figure 8:
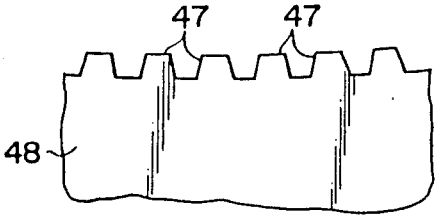
FIG. 8 is an enlarged partial view of the locking teeth of the pendulum.
Figure 5:
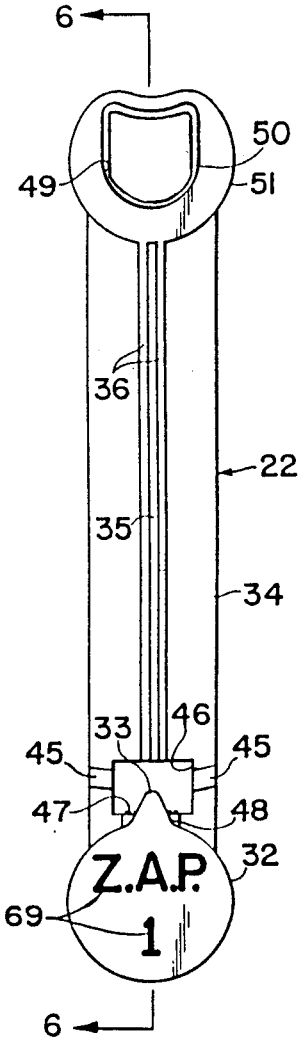
FIG. 5 is a front elevational view of the pendulum of FIG. 1.
Figure 6:
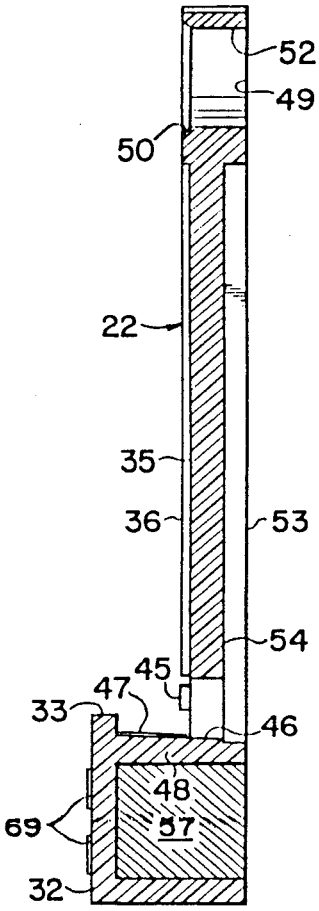
FIG. 6 is a cross section view of the pendulum of FIG. 5 taken on the line 6—6.
Figure 7:
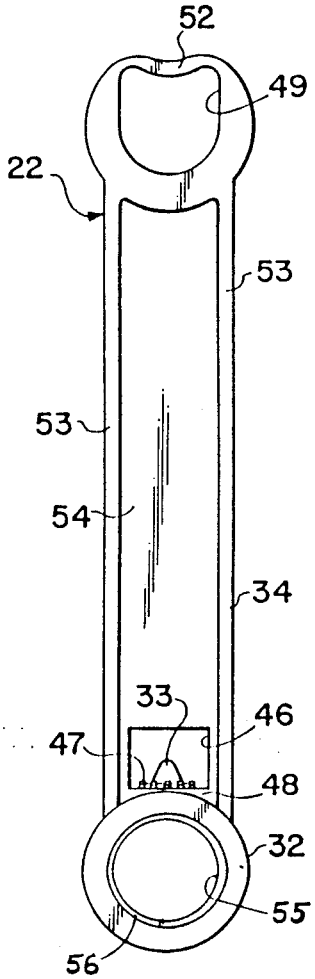
FIG. 7 is a rear elevational view of the pendulum of FIG. 5 with the lead weight removed.

With reference now to FIGS. 5–7, the structure of the pendulum 22 can be described. The pendulum 22 has a pendulum arm 34 with two parallel ridges 36 on the front side to define a vertical sight line 35. The lower portion of the pendulum 22 has two laterally extending bosses 45 which rest against boss 40 of the pendulum frame 21 in operation. This arrangement assists in holding the pendulum 22 securely in place. Square window 46 is placed therein for molding reasons. Teeth 47 are on the upper surface of an upwardly raised boss 48 that is formed at a slight rearward angle for molding purposes. The pendulum 22 is molded in one piece of glass fiber reinforced nylon. As more clearly shown in FIG. 8, the teeth 47 will securely engage the spaces between the teeth 44 on the lower portion 29 of pendulum frame 21 to lock the pendulum 22 securely in place in increments of approximately 0.015 inch. At the upper end portion 51 of the pendulum 22 an opening 49 has a tapered edge 50 to reduce friction and ease assembly. The uppermost wall 52 of upper end portion 51 is indented and is in the form of a slightly concave or U-shaped wall. As the pendulum 22 is pulled downwardly by an archer, wall 52 will slightly deform against boss 42' which then allows the teeth 47 to clear the surfaces of teeth 44 so that the pendulum 22 can be moved to a different position. When the pendulum 22 is now released, the resiliency of wall 52 will act against boss 42' to restore the engagement of teeth 44, 47 to lock the pendulum 22 into place. The rear surface of pendulum arm 34 has a smooth surface 54 with outwardly disposed, vertically parallel ridges or splines 53 to increase the rigidity of pendulum 22. The pendulum 22 and frame 21 are both independently pivotal around an axis through fixed sighting pin 23. When pendulum 22 is moved to a particular position and locked in place, it will exert a vertically downward force aided by lead weight 57 that fits in chamber 55 which has tapered circumferential edge 56. This downward force will rotate the pendulum frame 21 to a new position for proper sighting operations that will be discussed in more detail hereinbelow.

Figure 9:
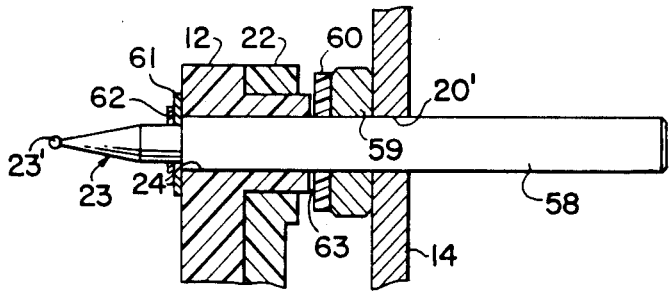
FIG. 9 is an enlarged detail of the assembly of the fixed sighting pin used in FIG. 1.

Fixed pin 23 is mounted as illustrated in FIG. 9. The pivot pin 23, a conventional device, includes a threaded brass rod 58 and a small sighting sphere 23' used for sighting a target. A flat washer 61 and retaining ring 62 may be used on the front of pin 23 with a nylon washer 60 and hex nut 59 on the rearward surface. As shown, there is a small space 63 between pendulum 22 and washer 60 because upper pendulum portion 51 has slightly less lateral thickness than pendulum frame boss 42. This arrangement allows for free movement of pendulum 22 independently of pivotal movement of frame 21 by minimizing the friction associated with the mounting apparatus. In addition hex nut 59 is set to allow for free movement of frame 21 and set into place using thread adhesive. The threaded rod portion 58 of fixed pin 23 fits through a threaded hole 20' in elevation bracket 14 as more clearly shown in FIG. 10. Only the upper hole 20' as shown, is used for a right-handed archer, and the lower hole 20' becomes the upper hole on the opposite side of the bow 13 when the bracket 20 is mounted on such opposite side of the bow 13. Of course, the pendulums are detached from the upper hole 20' and reconnected in the lower hole 20' when mounted on the opposite side of the bow.

Figure 12:
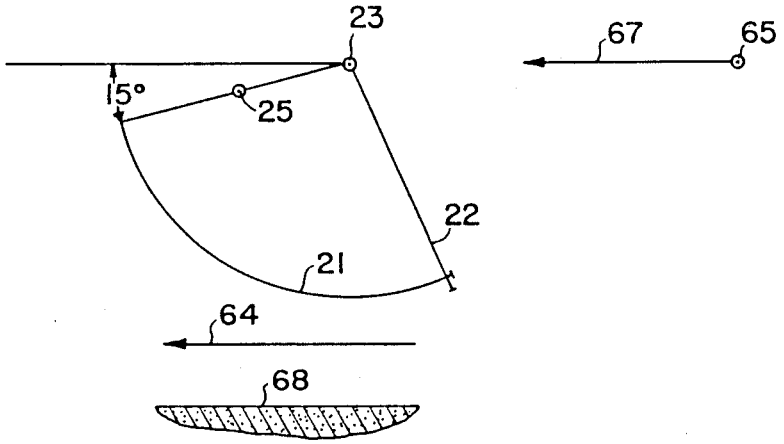

With reference now to FIGS. 11–15, a simplified diagram will be used to illustrate the use of the pendulum bow sight in accord with the present invention. As understood in the art, a bow 13 has an arrow rest which will define an arrow line-of-flight 64 and a bow string sight 65 mounted on a bow string 66 which is used to define the bow string line-of-sight 67. Initial calibration of the bow sighting apparatus employs bow sight 65 and fixed sighting pin 23. Beginning on level terrain 68, a target of known height such as twenty seven inches is placed at a measured distance from the archer. Preferably the initial calibration takes place at a target range where an arrow will fly with a flat trajectory. The distance will normally be about twenty yards. Arrows are fired at the target which is sighted through bow sight 65 establishing line-of-sight 67 through fixed pin 23 (FIG. 12). When the target is consistently hit, the pendulum sight frame 21 is fixed into vertical position via slot 16 and screws 18 to move the bracket 14 vertically and secure it into place. With the bow sighting apparatus thus initially calibrated, the fixed pin 23 can now be used to sight any target within the flat trajectory range of the bow 13 that is being used.

After the initial sight-in, the archer fires at targets at greater distances, for example, thirty yards. The arrow will fly low because, in this example, thirty yards is beyond the flat trajectory range used initially to set the position of pin 23. The pendulum pin 25 is initially positioned in slot 28 with reference to the strength or poundage of the particular bow 13 that is being used. For a high-strength, i.e., high poundage, bow the pendulum pin 25 is moved inwardly toward the fixed pin 23. For a low poundage bow, the pin 25 is moved outwardly away from pin 23 to cause a greater tilt of the bow upwardly, when sighted by the archer, for longer range. In short, the position of pin 25 is set to compensate for the amount of departure from flat trajectory for a given distance beyond the flat trajectory range, the departure being greater the lower the bow poundage.

Figure 13:
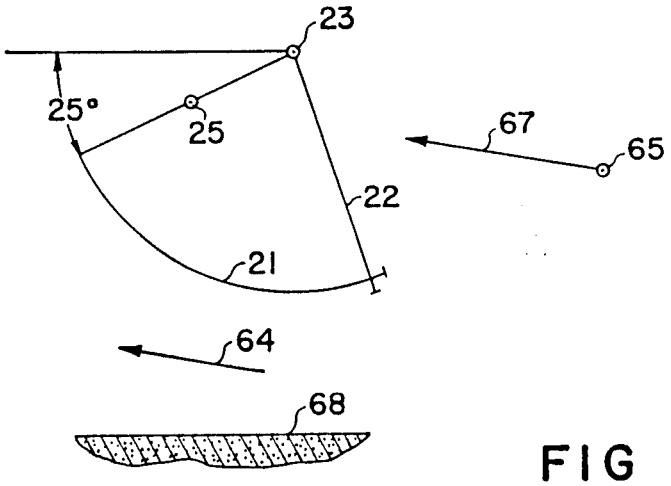

With pendulum pin 25 properly positioned, the pendulum 22 is moved along the arcuate teeth 44 by pulling it down to disengage the teeth 44, 47 and placing it in a position where the target is hit when sighting from bow sight 65 through pendulum pin 25 (FIG. 13). An appropriate range marking 31 can be placed on marking strip 30. Once this is done, any time that the pendulum pointer 33 is aligned with the appropriate range mark 31 and the pendulum pin 25 sighted on the target, the arrow will strike the target. As can be understood in combination with discussion of the construction details described hereinabove, when the pendulum 22 is moved to place pointer 33 in alignment with a given range mark 31, the pendulum 22 will remain in a substantially vertical position while pendulum frame 21 is rotated counterclockwise a given distance (for a right-handed archer). This action lowers the pendulum pin 25 with respect to the bow sight line-of-sight 67 with the result that the archer must angle the arrow line-of-flight 64 upwardly to hit the target by tilting the bow 13 upwardly to place pin 25 on the target. This procedure is repeated at all distances the archer is interested in. The pendulum bow sight 10 is now calibrated for shooting from a ground position with the bow 13 at a height of approximately five feet.

Figure 14:
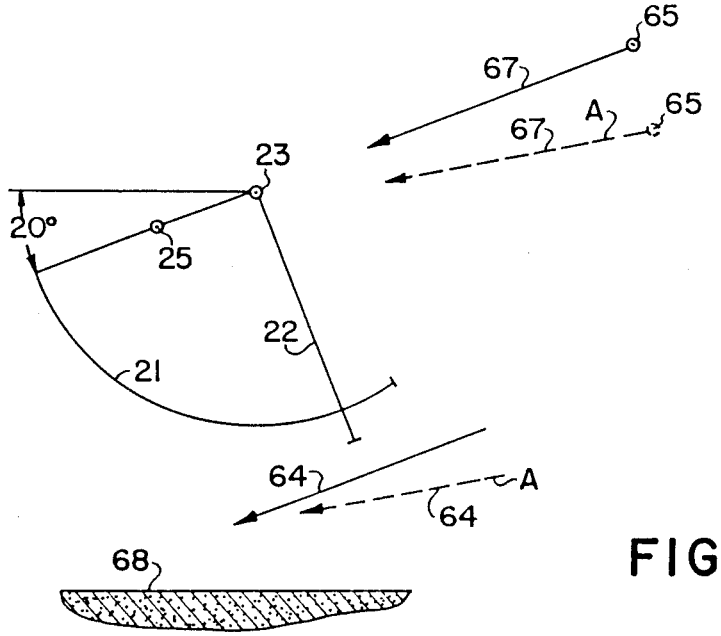
Figure 15:
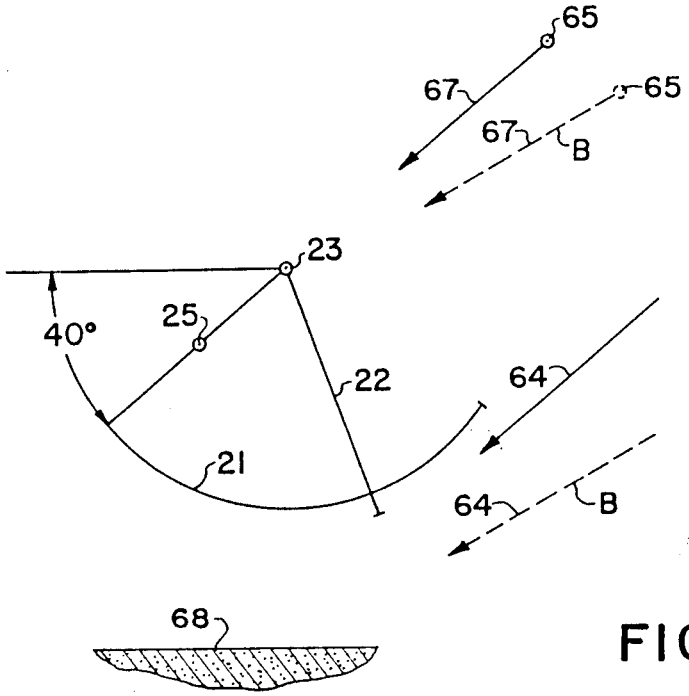

With reference to FIG. 14, the calibration procedure for use of the bow sighting apparatus from an elevated position, such as a tree stand, can be described. A target is erected at a distance, as measured from a point directly below the tree stand, that is within the flat trajectory range of the bow 13. This distance should be the same distance used in the level ground calibration, for example, 20 yards. The archer will now sight the target using fixed pin 23 and move the pendulum 22 into a position where, when secured into position by the engagement of teeth 44 and 47, the pendulum pin 25 will be directly in line with fixed pin 23. At this point only fixed pin 23 will be visible and on the target. The total height from ground to the shoulder can be marked on strip 30. Here again, the pendulum pin 25 is used for sighting at a target of greater distance than the flat trajectory range as indicated in broken lines A. If the archer moves to a higher tree stand, the pendulum 22 is moved to a position to align the pins 25 and 23 and is secured into place (FIG. 15).

The basic theory of the pendulum bow sight 10 is that of maintaining the same relationship between the bow sight line-of-sight 67, which is the angle to the target via pin 23 or 25, and the arrow line-of-flight 64 whether the bow is used from an elevated tree stand or on level terrain. This is only possible with a device where the pendulum reference, the quadrant-shaped frame 21, is independently pivotal with respect to the bow mounting arm 20. When used on level terrain, the fixed pin 23 is used for shooting within the flat trajectory range and the pendulum pin 25 is used for sighting targets at greater distances. When used from a tree stand, pins 23 and 25 are placed in-line by movement of pendulum 22 to rotate pendulum frame 21. Pendulum pin 25 is still used for greater distances than the flat trajectory range.

As understood from the usual trigonometric principles, the actual arrow flight distance from a tree stand will be longer than the calibration distance for the same target. More specifically, the arrow flight distance will increase with increasing tree stand height with respect to the increasing angle between the flight line and the ground or the decreasing angle between the flight line and the tree stand height line. As tree stand height increases, pendulum 22 is moved to the appropriate marking 31 causing rotation of frame 21 counterclockwise (for a right-handed archer) an angular amount equal to the increase in the flight-to-ground angle with the result that pin 25 is lowered this amount with respect to pin 23. This will require the same angle of tilt of the bow 13 to place pins 23 and 25 back in line. The movement of pendulum 22 away from the archer as tree stand height increases has the effect of changing the angular position of pin 25 with respect to the arcuate portion of frame 21 to keep the pins 23, 25 aligned on the target. If the pins 23, 25 cannot be placed in line on the target, the distance to the target is greater than the calibration distance and pin 25 is sighted on the target, as in broken line position B of FIG. 15. This will result in the appropriate upward tilt of the bow 13 to compensate. This is, of course, the same principal used on level ground. If pins 23, 25 can be aligned on the target, the pointer 33 will indicate the ground range via the markings 31.

In summary, when using a higher or lower tree stand, the pendulum 22 is moved to place sight line 35 at the appropriate tree stand marking 31 and sighting can proceed for the target range. Movement of pendulum 22 forwardly or rearwardly, respectively, will cause pendulum pin 25 to be lowered or raised, respectively, with respect to fixed pin 23 thus allowing for an accurate sighting.

In other words, both frame 21 and pendulum 22 function as pivoting pendulum elements to adjust the reference of the frame 21 for tree stand height and thus always allow the archer t shoot either through the fixed pin 23 for distances within the flat trajectory range or the pendulum pin 25 for greater distances. The two-pendulum element design of the present invention thus allows calibration and use of the bow 13 on either level ground or at different tree stand heights without the loss of accuracy associated with the other pendulum type sighting devices known to the prior art. The marking 69 Z. A. P. 1 in FIGS. 5 and 6 stands for pendulum 1" and refers to the fact that the angle of the arrow on the bow which is the same as flight line 64 and the angle of the target from the bow which is the same as sight line 67 is the same and remains the same as the archer's height changes when the pendulum 22 is pivotally positioned with respect to frame 21 as described hereinabove.

Furthermore, the present invention works on terrain 68 that is sloping either upwardly or downwardly because of the zero relative angle between the line-of-sight 67 through the pin 23 and the arrow line-of-flight 64. Both pins 23 and 25 are adjustable in length for the usual windage corrections.

The preferred embodiment of the pendulum 22 uses the deformably resilient wall portion 52 as a means for selectively providing sufficient downward movement of teeth 47 to allow for disengagement from teeth 44. Alternatively, the pendulum arm 22 may have an arm portion 34 that is itself deformably resilient and accordingly, the length of the pendulum 22 can be stretched a sufficient amount to allow for disengagement of teeth 44, 47. Finally, when downward force is applied to the lower portion 32 of pendulum 22, the arm portion 34 may "bow" slightly and thus allow for movement of the pendulum 22. In these alternate constructions of the pendulum 22 it is important to keep in mind that the tooth height is only 0.010 inches and that teeth 44 and 47 are disposed at a slight angle of about 3° from the horizontal. Accordingly, only a small downward movement is needed to disengage the teeth 44 and 47.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A bow sight to enable an archer to aim at a target accurately when using a bow from a plurality of elevated positions or from a ground level position comprising mounting means for attaching said bow sight to a bow, a first pendulum having an upper portion and a lower portion and being adapted to respond to gravity, said lower portion including a weight portion, a second pendulum adapted to respond to gravity, pivot means for mounting said first and second pendulums to said mounting means about a common pivot axis above the center of gravity of each said pendulum, said pivot means being adapted to allow each said pendulum to move freely about said axis, a first sighting element, first attaching means for securing said first sighting element to said second pendulum, a second sighting element spaced away from said first sighting element and being fixed with respect to said pendulums, and selective means for selectively securing said first pendulum to said second pendulum at each of a plurality different locations to cause pivotal motion of said second pendulum in response to movement of said weight portion when said first pendulum is moved from one said location to another said location for raising or lowering the elevation of said first sighting element with respect to said second element.

2. The bow sight as defined in claim 1 wherein said first pendulum includes a pointer for indicating a selected location of said first pendulum with respect to said second pendulum, said second pendulum having an upper portion and a lower arcuate portion, said arcuate portion being adapted to receive indicia thereon by the archer to record the position of said pointer at each said selected location of said first pendulum.

3. The bow sight as defined in claim 2 wherein said first pendulum further includes a vertically disposed rib along the length thereof for indicating a selected location of said first pendulum with respect to said second pendulum, said lower arcuate portion being adapted to receive second indicia thereon by the archer to record the position of said rib at each said selected location of said first pendulum.

4. The bow sight as defined in claim 1 wherein said first pendulum includes a line means for indicating each said selected location of said first pendulum with respect to said second pendulum at a plurality of corresponding elevated positions of an archer, said first and second sighting elements being positioned in alignment at each said selected location by movement of said first pendulum by the archer.

5. The bow sight as defined in claim 1 wherein said first pendulum includes a means for indicating each said selected location of said first pendulum with respect to said second pendulum at a plurality of corresponding distances of a target from an archer, said first sighting element being raised or lowered with respect to said second sighting element for each said corresponding distance by movement of said first pendulum by the archer.

6. The bow sight as defined in claim 1 wherein said second pendulum includes at least one elongated slot, said first attaching means includes releasable fastening means for securing said first sighting element to said second pendulum at any position along the length of said slot to adjust the position of said first sighting element for different bow strengths.

7. The bow sight as defined in claim 1 further comprising second attaching means for securing said second sighting element to said pivot means to align said second sighting element with said pivot axis.

8. The bow sight as defined in claim 1 wherein said second pendulum includes an upper portion, an arcuate lower portion having opposite end portions, and a pair of spaced arms, one said arm being connected between said upper portion and one said end portion of said arcuate lower portion, the other said arm being connected between said upper portion and another said end portion of said arcuate lower portion, each said arm member having an elongated slot therein, said first attaching means including releasable fastening means to secure said first sighting element into either of said slots.

9. The bow sight as defined in claim 8 wherein said releasable fastening means is adapted for slidably positioning said first sighting element at any position in either said elongated slot.

10. The bow sight as defined in claim 1 wherein said second pendulum includes a front surface and a rear surface, said pivot means positioning said first pendulum closely adjacent said rear surface, said selective means including first and second teeth oppositely disposed on respective said first and second pendulums, said first teeth being releasably cooperatively engaged with said second teeth to secure said first pendulum to said second pendulum at any said location.

11. The bow sight as defined in claim 10 wherein upper portion of said first pendulum includes a first passageway therethrough for receiving said pivot means, said first passageway including a deformably resilient wall portion for selectively allowing movement of said first pendulum with respect to said second pendulum to disengage said first teeth from said second teeth when said wall portion is deformed.

12. The bow sight as defined in claim 10 wherein said lower portion of said first pendulum includes a laterally extending boss with an upper and lower portion, said first teeth being disposed upwardly on said upper portion of said boss, said second pendulum having an upper portion and an arcuate lower portion, said arcuate lower portion having a bottom surface, said second teeth being disposed downwardly on said bottom surface.

13. The bow sight as defined in claim 12 wherein said pivot axis passes through said upper portion of said first pendulum, said upper portion of said first pendulum having a deformably resilient portion for allowing downward radial movement of said first pendulum with respect to said pivot axis for moving said first teeth downwardly to permit disengagement of said first teeth from said second teeth when said resilient portion is deformed.

14. The bow sight as defined in claim 12 wherein said boss includes a recess and further comprises a weight disposed within said recess and firmly attached to said boss.

15. A bow sight to enable an archer to aim at a target accurately from a plurality of elevated positions or from a ground level position when using a bow having a bow string sight on the bow string of the bow comprising mounting means for attaching said bow sight to a bow, a first pendulum element having an upper portion and a lower portion and being adapted to respond to gravity, a weight attached to said lower portion, a second pendulum element adapted to respond to gravity, pivot means for mounting said first and second pendulum elements to said mounting means about a common pivot axis above the center of gravity of each said pendulum element, said pivot means being adapted to allow each said pendulum element to move freely about said axis, a first sighting pin first means for securing said first sighting pin to said second pendulum element, a second sighting pin spaced away from said first pin and being fixed with respect to said first and second pendulum elements, second means for securing said second pin to said pivot means to align said second pin with said axis, and locking means for selectively securing said first pendulum element to said second pendulum element at each of a plurality of positions thereon to cause pivotal motion of said second element in response to movement of said weight and lower portion when said first element is moved from one said position to another said position for raising or lowering the elevation of said first pin with respect to said second pin and said bow string sight.

16. The bow sight as defined in claim 15 wherein said first sighting pin is secured to said second pendulum element at a point forwardly of said axis and said bow string sight.

17. The bow sight as defined in claim 16 wherein said first sighting pin is secured to said second pendulum element at a point below said axis.

18. The bow sight as defined in claim 15 wherein said first pendulum element includes a pointer for indicating each said selected position of said first pendulum element with respect to said second pendulum element.

19. The bow sight as defined in claim 15 wherein said pivot means positions said first and second pendulum elements are closely adjacent to each other and restrict axial movement of said first and second pendulum of said elements along said axis.

20. The bow sight as defined in claim 19 wherein each of said first and second pendulum elements has a rear surface and a front surface, said front surface of said first element being positioned closely adjacent said rear surface of said second pendulum element, said locking means including first and second oppositely disposed teeth on respective said first and second pendulum elements, said first teeth being releasably cooperatively engaged with said second teeth to secure said first pendulum element to said second pendulum element at any selected said position.

21. The bow sight as defined in claim 20 wherein said first pendulum element includes a flexible upper portion adapted to selectively allow radial movement of said first pendulum element with respect to said pivot axis when manual force is applied to said first pendulum element to disengage said first teeth from said second teeth for pivotal movement of said first pendulum element with respect to said second pendulum element when manual force is selectively applied to said first pendulum element.

22. The bow sight as defined in claim 20 wherein said first pendulum element includes an upper portion having a deformably resilient section for selectively allowing movement of said first pendulum element with respect to said second pendulum element to disengage said teeth when said section is deformed.

23. The bow sight as defined in claim 19 wherein said second pendulum element includes a laterally extending substantially rigid boss on said upper portion, said upper portion of said first pendulum element having a first passageway for receiving said boss therethrough for pivotal movement of said first pendulum element with respect to said second pendulum element, said boss including a second passageway therethrough, said pivot axis passing through said second passageway.

24. The bow sight as defined in claim 23 wherein said first passageway includes a deformably resilient section at the upper portion thereon, said section being formed as a concave wall, a portion of said wall being in contact with said boss and being deformed thereby when a manual downwardly directed force is applied to said first pendulum element.

25. A bow sight to enable an archer to aim at a target accurately when using a bow from a plurality of elevated positions or from a ground level position comprising mounting means for attaching said bow sight to a bow, a pendulum member having an upper portion and a lower portion and being adapted to respond to gravity, a weight attached to said lower portion, a quadrant member adapted to respond to gravity, pivot means for mounting said pendulum member and said quadrant member to said mounting means about a common pivot axis above the center of gravity of each said pendulum and quadrant member, said pivot means allowing each said pendulum and quadrant member to move freely about said axis, a first sighting element, first attaching means for securing said first sighting element to said quadrant member, a second sighting element spaced away from said first sighting element and being fixed with respect to said members, and selective means for securing said pendulum member to said quadrant member at each of a plurality of different locations to cause pivotal motion of said quadrant member in response to movement of said lower portion and weight when said pendulum member is moved from one said location to another said location for raising or lowering the elevation of said first sighting element with respect to said second sighting element, said pendulum member having a pointer adjacent said lower portion for indicating each said location selected on said quadrant member with respect to said pendulum member at a plurality of corresponding ground range distances of a target from an archer at a ground level position, said pendulum member having a vertically disposed rib for indicating each said selected location of said pendulum member with respect to said quadrant member at a plurality of corresponding elevated positions of an archer with respect to a target, said quadrant member including a lower arcuate portion adapted to receive first indicia and second indicia placed thereon by an archer to record the position of said pointer at each selected ground range distance and the position of said rib at each selected elevated position, respectively.

26. The bow sight as defined in claim 25 wherein said quadrant member includes an upper portion, an arcuate lower portion having opposite end portions, and a pair of spaced arms, one said arm being connected between said upper portion and one said end portion of said arcuate lower portion, the other said arm being connected between said upper portion and another said end portion of said arcuate lower portion, each said arm member having an elongated slot therein, said first attaching means including releasable fastening means to secure said first sighting element into either of said slots.

27. The bow sight as defined in claim 26 wherein said fastening means is adapted for slidably positioning said first sighting element at any position in either said elongated slot.

28. The bow sight as defined in claim 25 wherein said quadrant member includes a front surface and a rear surface, said pivot means positioning said pendulum member closely adjacent said rear surface, said selective means including first and second oppositely disposed teeth on respective said pendulum member and said quadrant member, said first teeth being releasably cooperatively engaged with said second teeth to secure said pendulum member to said quadrant member at any said location.

29. The bow sight as defined in claim 28 wherein upper portion of said pendulum member includes a first passageway therethrough for said mounting of said pendulum member by said pivot means about said common pivot axis, said first passageway including a deformably resilient wall portion for selectively allowing movement of said pendulum member with respect to said quadrant member to disengage said first teeth from said second teeth when said wall portion is deformed.

30. The bow sight as defined in claim 28 wherein said lower portion of said pendulum member includes a laterally extending boss with an upper and lower portion, said first teeth being disposed upwardly on said upper portion of said boss, said quadrant member having an upper portion and an arcuate lower portion, said arcuate lower portion having a bottom surface, said second teeth being disposed downwardly on said bottom surface, said pivot axis passing through said upper portion of said pendulum member, said upper portion of said pendulum member having a deformably resilient portion for allowing downward radial movement of said pendulum member with respect to said pivot axis for moving said first teeth downwardly to permit disengagement of said first teeth from said second teeth when said resilient portion is deformed.

* * * * *